United States Patent [19]

Kikuchi et al.

[11] 4,367,611

[45] Jan. 11, 1983

[54] CAGE SLOT GRINDING MACHINE

[75] Inventors: Makoto Kikuchi; Akiyoshi Kobayashi, both of Kariya, Japan

[73] Assignee: Toyoda Koki Kabushiki Kaisha, Kariya, Japan

[21] Appl. No.: 218,211

[22] Filed: Dec. 19, 1980

[30] Foreign Application Priority Data

Dec. 19, 1979 [JP] Japan ..... 54-165212

[51] Int. Cl.[3] ..... B24B 5/36

[52] U.S. Cl. ..... 51/41; 51/46; 51/85 R; 51/86 R; 51/5 D

[58] Field of Search ..... 51/5 D, 34 C, 34 E, 51/35, 40, 41, 42, 83 R, 84 R, 46, 86 R, 85 R, 88, 290, 291, 330; 409/192, 203, 213, 217

[56] References Cited

U.S. PATENT DOCUMENTS

| | | | |
|---|---|---|---|
| 810,903 | 1/1906 | Blechschmidt | 51/34 C |
| 1,134,658 | 4/1915 | Woods et al. | 51/83 R |
| 1,856,185 | 5/1932 | Guild | 51/42 X |
| 2,307,640 | 1/1943 | Rzeppa | 51/46 |
| 2,410,348 | 10/1946 | Johanson et al. | 51/84 R |

*Primary Examiner*—Stephen G. Kunin

*Assistant Examiner*—Robert P. Olszewski

*Attorney, Agent, or Firm*—Oblon, Fisher, Spivak, McClelland & Maier

[57] ABSTRACT

A cage slot grinding machine having a work head whose work spindle is rotationally indexable by an index device and first and second wheel supports which respectively carry first and second grinding wheels for grinding, two at a time, cage slots of a cage member on the work spindle. Each time the indexing of the work spindle is carried out, the first and second wheel supports are moved by respective traverse feed devices in a direction perpendicular to the work spindle axis but in opposite senses so as to extend the first and second grinding wheels respectively into two of the cage slots. The first and second grinding wheels, after being so extended, are infed in a second direction parallel to the work spindle axis but in opposite senses through the movements of the wheel supports by respective infeed devices, during which the work spindle is pivotally oscillated by an oscillating device through a predetermined angular distance. Consequently, edges on one side of all of the cage slots are ground with the first grinding wheel while edges in the other side of all of the cage slots are ground with the second grinding wheel.

5 Claims, 10 Drawing Figures

CAGE SLOT GRINDING MACHINE

BACKGROUND OF THE INVENTION

1. Field of the Invention

The present invention relates to machines for grinding slots of ball cage members such as used in torque transmitting universal joints.

2. Description of the Prior Art

In grinding the slots of ball cage members, it is a basic requirement that, as shown in FIGS. 1 and 2, the edges in one side of the six slots Wp of a cage member W be ground into alignment with a line A and that edges Wb in the outer side of the six slots Wp be ground into alignment with another line B, thereby making the widths of the six cage slots Wp identical with one another in the axial direction of the cage member W.

However, a known grinding machine of this type as disclosed in U.S. Pat. No. 2,307,640 to A. H. Rzeppa is not designed to grind the edges Wa in one side of the six cage slots Wp with a common grinding wheel and to grind the edges Wa in the other side of the six cage slots Wp with another common grinding wheel. This causes the finish accuracy of the edges in either side to be degraded due to a variance in the infeed dead stop positions or in the dressing infeed end positions. Using the known grinding machine, it is therefore difficult and substantially impossible to grind the six cage slots Wp so that the six edges Wa in one side are aligned with the line A, and that the six edges Wb in the other side are aligned with the line B.

SUMMARY OF THE INVENTION

Accordingly, it is a principal object of the present invention to provide an improved cage slot grinding machine whereby a plurality of slots of a cage member can be ground not only to be identical in width with one another but also to be aligned about the circumference of the cage member.

Another object of the present invention is the provision of an improved grinding machine of the character set forth above capable of grinding a plurality of slots of a cage member with high efficiency and in substantially the same grinding condition as one another.

Briefly, in a cage slot grinding machine according to the present invention, there is provided a work head rotatably carrying a work spindle, on one end of which a cage member to be ground is removably mounted. An index device is connected with the work spindle to selectively bring a plurality of slots on the cage, two at a time, into alignment with first and second grinding wheels through the rotation of the work spindle. Each time two new cage slots are respectively brought into alignment with the first and second grinding wheels, the same are respectively extended into the two new cage slots through the movement of first and second wheel supports in a first direction perpendicular to the axis of the work spindle but in opposite directions. The first and second wheel supports, after being so moved, are advanced in a second direction parallel to the axis of the work spindle to impart infeed movements respectively to the first and second grinding wheels. A pivotal oscillatory device is further provided which gives the work spindle an oscillatory pivotal movement along a predetermined angular distance during the movement of the wheel supports in the second direction. These wheel supports, when moved in the second direction, are advanced in opposite directions whereby the edges on one side of all of the cage slots are ground with the first grinding wheel while the edges on the other side of all of the cage slots are ground with the second grinding wheel.

According to the present invention, efficient grinding is realized since the edge on one side of a cage slot and the edge on the other side of another cage slot are simultaneously ground. More importantly, no variance in size is provided with respect to finished edges on any side of any of the cage slots. In other words, all of finished slots of any cage member are circumferentially aligned with one another, with the edges in one side being encompassed in a plane and with the edges in the other side being all encompassed in another plane. This advantage is achieved by the unique utilization of two grinding wheels on one grinding machine, that is by using the first grinding wheel for the edges on one side and the second grinding wheel for the edges on the other side.

BRIEF DESCRIPTION OF THE DRAWINGS

The foregoing and other objects and many of the attendant advantages of the present invention will be readily appreciated as the same becomes better understood by reference to the following detailed description when considered in connection with the accompanying drawings, wherein like reference numerals designate like or corresponding parts throughout the several views, and in which.

DETAILED DESCRIPTION OF THE PREFERRED EMBODIMENT

Figure 1:
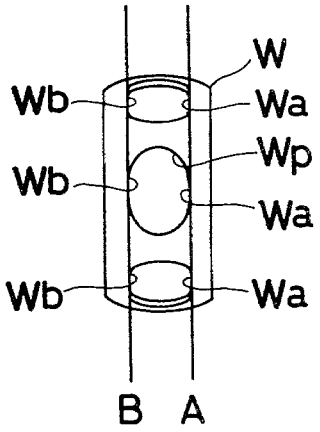
FIG. 1 is a front view of a cage member and a workpiece to be ground.
Figure 2:
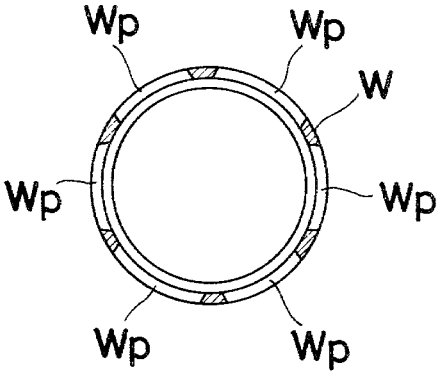
FIG. 2 is a sectional view of the cage member.
Figure 3:
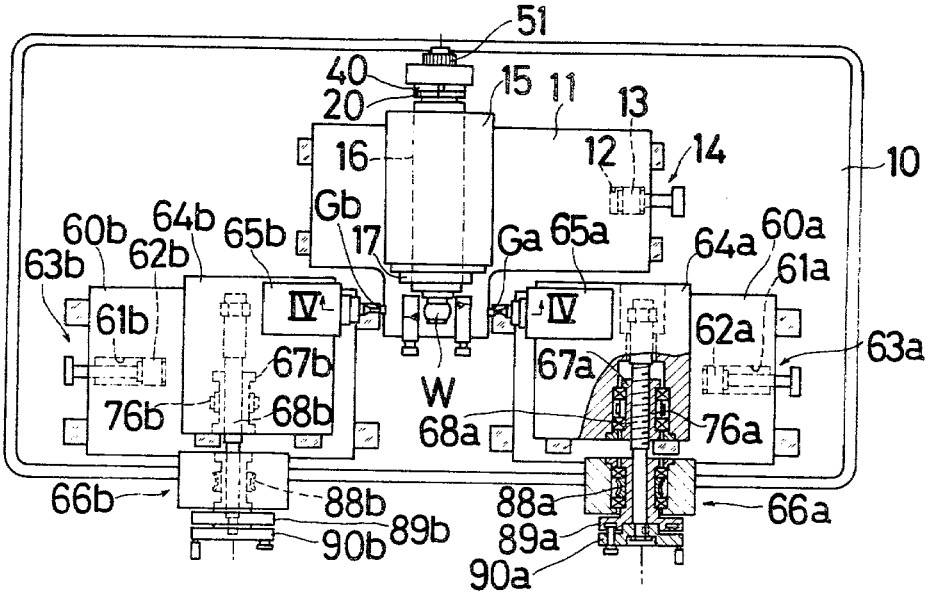
FIG. 3 is a plan view, partly in section, of a cage slot grinding machine according to the present invention.

Referring now to FIG. 3, a cage slot grinding machine according to the present invention is shown having a bed 10, on which a work slide 11 is carried for sliding movement in a direction perpendicular to the axis of a work spindle, referred to later. An oscillatory device 14, including a hydraulic actuator 12 and a piston 13, is provided on the bed 10 for sliding movement of the work slide 11 in said direction. The work slide 11 fixedly mounts thereon a work head 15 rotatably supporting a work spindle 16. This spindle 16 has secured at one end thereof a chuck 17 adapted to clamp a cage member W, which has six radial slots Wp as shown in FIGS. 1 and 2, and which is used in conventional torque transmitting universal joints.

Figure 3B:
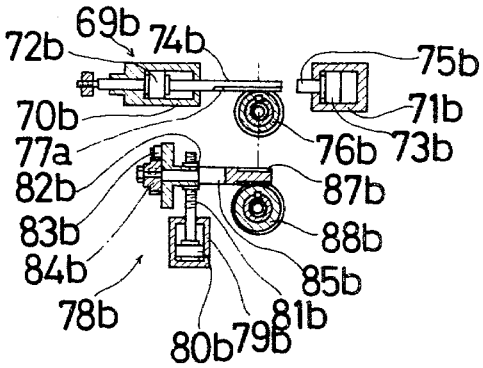
FIGS. 3*a*–3*c* are schematic illustrations of control devices associated with the structure of FIG. 3.
Figure 3A:
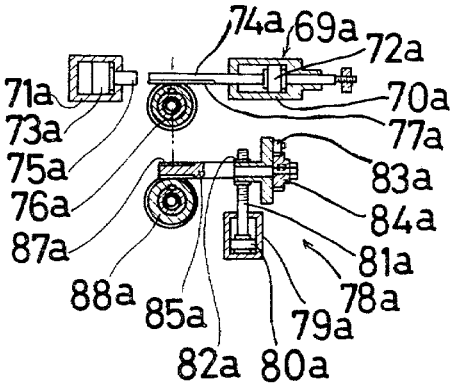
Figure 3C:
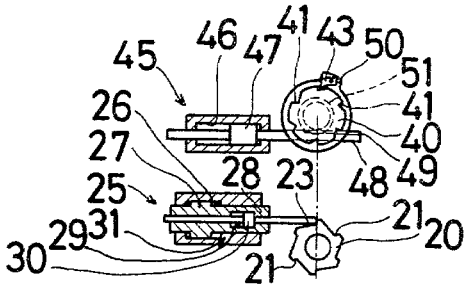

The other end of the work spindle 16 is provided with first and second indexing plates 20 and 40 keyed thereon. As schematically shown in FIG. 3*c*, the first indexing plate 20 has six stops 21 spaced in equiangular relation. The second indexing plate 40 also has six notches 41 spaced in equiangular relation, but oriented in a direction opposing the stops 21. A rod 23 and a pawl 43 are respectively engageable with any of the stops 21 and any of the notches 41 from such directions that they urge the plates 20 and 40 to rotate in opposite directions, respectively. At the rear side of the work head 15, there are provided a reciprocation drive device 25 for reciprocating the rod 23 and an index drive device 45 for pivotally moving the pawl 43.

The reciprocation drive device 25 is composed of a hydraulic cylinder 26 slidably receiving a piston 27 therein. The piston 27 is reciprocally moved by supplying pressurized fluid selectively into left and right chambers of the cylinder 26. A rod 28 of the piston 27 contains therein a set-free device 31 including a piston 30 slidable in the rod 28. This set-free device 31 serves for bringing the rod 23 of the piston 30 into and away from contact with any of the stops 21.

The indexing drive device 45 is constituted by a hydraulic cylinder 46 and a piston 47 slidably received therein. A rod 48 of the piston 47 is formed with rack teeth 49, which engage a pinion 51 rotatable bodily with a rotational member 50 on the work spindle 16. This arrangement permits straight movement of the piston 47 to be transmitted as rotational movement to the pinion 51 and the rotational member 50. The pawl 43 is pivotably carried on a lateral surface of the rotational member 50. Therefore, the member 50, when rotated in counterclockwise direction, brings the pawl 43 into engagement with any of the notches 41 to rotate the second indexing plate 40 through a predetermined angle, but when rotated in clockwise direction, slides the pawl 43 along the circumferential surface of the second indexing plate 40 to a retracted angular position.

Further, first and second wheel slides **60*a* and 60*b* are mounted on the bed 10 and respectively at diametrically opposite sides of the chuck 17. In order to move the wheel slides 60*a* and 60*b* in a direction perpendicular to the axis of the work spindle 16, first and second feed devices 63*a* and 63*b* are provided, comprising a set of a hydraulic cylinder 61*a* and a piston 62*a* and another set of a hydraulic cylinder 61*b* and a piston 62*b*. First and second wheel supports 64*a* and 64*b* are in turn mounted respectively on the first and second wheel slides 60*a* and 60*b* for sliding movement in a direction parallel with the axis of the work spindle 16. First and second wheel heads 65*a* and 65*b*, fixedly mounted respectively on the first and second wheel supports 64*a* and 64*b*, respectively support first and second grinding wheels Ga and Gb for rotation about axes perpendicular to the axis of the work spindle 16. First and second infeed devices 66*a* and 66*b* are provided for respectively infeeding the first and second wheel supports 64*a* and 64*b* in a direction parallel to the axis of the work spindle 16 but in opposite directions with each other. Accordingly, the first grinding wheel Ga is infed toward the edge on one side of a cage slot Wp, while the second grinding wheel Gb is infed toward the edge on the other side of another slot Wp, as best shown by the phantom lines in FIG. 5**.

The first infeed device **66*a* is composed of a nut 67*a* rotatably, but axially fixedly supported on the first wheel support 64*a* and a screw shaft 68*a* threadedly engaged with the nut 67*a*. The relative rotation of one of the nut 67*a* and the screw shaft 68*a* to the other effects a grinding or dressing infeed movement of the first wheel support 64*a* and hence, the first grinding wheel Ga. In order to give the nut 67*a* rotation, a grinding infeed device 69*a* (FIG. 3*a*) is provided including a rapid feed cylinder 70*a* and a grinding infeed cylinder 71*a*, in which pistons 72*a* and 73*a* are respectively slidably contained. The piston rods 74*a* and 75*a* of the pistons 72*a* and 73*a* are in axial alignment with each other for abuttable engagement. The piston rod 74*a* is formed with rack teeth 77*a* engaged with a pinion 76*a*, which is keyed on the nut 67*a*. The operation of the grinding infeed device 69*a* is such that the piston 72*a* is advanced at a rapid feed rate until the abutting engagement of its rod 74*a* with the piston rod 75*a* and, after such engagement, at a slow feed rate by being subjected to the displacement of the piston 73*a*. The rack teeth 77*a* and the pinion 76*a* engaged therewith serve to transmit the movement of the piston 72*a* to the nut 67*a***.

In order to rotate the screw shaft **68*a*, on the other hand, a dressing infeed device 78*a* is provided being embodied as a known rachet feed mechanism which is composed of a hydraulic cylinder 79*a*, a piston 80*a*, rack teeth 81*a*, a pinion 82*a*, a ratchet pawl 83*a* and a ratchet wheel 84*a*. Intermittently rotatably by the ratchet mechanism is a worm shaft 85*a* with a worm 87*a*, which is in meshing engagement with a worm wheel 88*a* keyed on a rotational sleeve 89*a*. This sleeve 89*a* is freely rotatable about the screw shaft 68*a* and is disengageably connected with a hand wheel 90*a* keyed on one end of the screw shaft 68*a*. Accordingly, this arrangement serves to transmit the intermittent rotation of the worm shaft 85*a* to the screw shaft 68*a***.

The second infeed device **66*b* is identical in construction with the first infeed device 66*a* and therefore, is not described in detail. It should be noted however that in the drawings, particularly FIG. 3*b*, the parts of the second infeed device 66*b* which correspond respectively to those of the first infeed device 66*a*** are designated by the same reference numerals each with appended letter "b" instead of "a."

Figure 4:
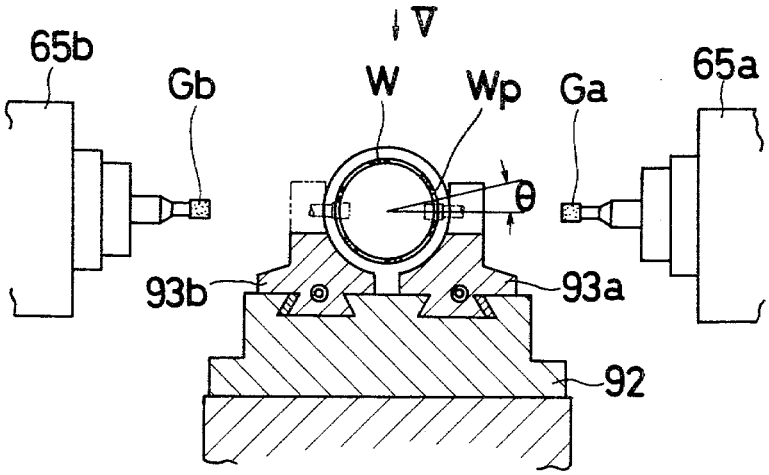
FIG. 4 is a sectional view of the grinding machine taken along the line IV—IV of FIG. 3.
Figure 5:
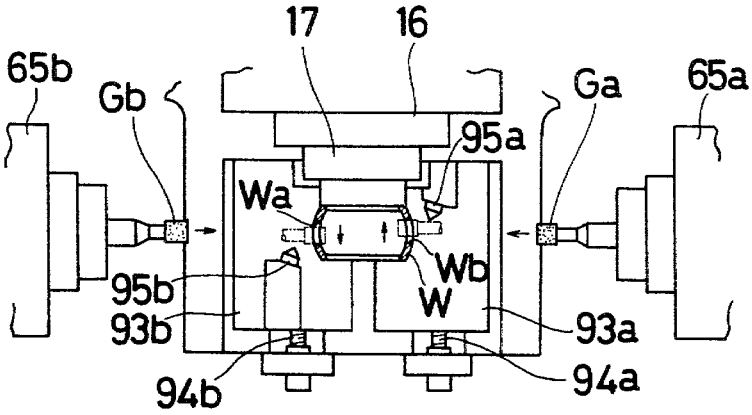
FIG. 5 is a plan view of the grinding machine looking from a direction indicated by the arrow V of FIG. 4.

Referring to FIGS. 4 and 5, a dresser base 92 is fixedly provided on the work slide 11 and immediately under the cage member W on the chuck 17. The dresser base 92 mounts thereon first and second dresser supports **93*a* and 93*b*, which are displaceable in a direction parallel to the axis of the work spindle 16. Adjusting screws 94*a* and 94*b* are manually rotatable to respectively adjust the slide positions of the dresser supports 93*a* and 93*b* in said direction. First and second dressing tools 95*a* and 95*b*, secured respectively to the dresser supports 93*a* and 93*b*, are respectively oriented in inwardly opposite directions in the vicinity of diametrically opposite ends of the cage member W on the chuck 17. The dressing tools 95*a* and 95*b* are provided for respectively dressing the first and second grinding wheels Ga and Gb. The dresser supports 93*a* and 93*b*, though positioned on the work slide 71 in this particular embodiment, may be mounted on the bed 10**.

The operation of the apparatus as constructed above will be described hereinafter. It is now assumed that all movable members of the grinding machine are in their original positions as illustrated in FIG. 3 and that the cage member W to be ground has been clamped in place on the chuck 17. In this original condition, the right chamber of the cylinder 26 and the left chamber of the cylinder 29 have received fluid under pressure, with the pistons 27 and 30 urged respectively to the left and right stroke ends thereof. Also, the left chamber of the indexing cylinder 46 has received fluid under pressure, with the piston 47 being urged toward the right. The first and second indexing plates 20 and 40 have therefore been engaged at one of the stops 21 and one of the notches 41 through the rod 23 and the pawl 43, respectively, so as to maintain the work spindle 16 at the angular position that the pistons 27 and 30 respectively determine at the left and right stroke ends thereof. The cage member W and the chuck 17, when at the shown angular position, has brought a pair of diametrically opposite slots Wp thereof into axial alignment with the first and second grinding wheels Ga and Gb, as shown in FIG. 4.

When fluid under pressure is supplied alternatively into the left and right chambers of the reciprocation cylinder 26, after the above-noted original condition, the piston 27 is reciprocally moved, whereby the work spindle 16 and the cage member W on the chuck 17 are rotatably moved about a predetermined angular distance $\theta$ (FIG. 4) which corresponds to the length, in the circumferential direction, of the cage slots Wp. During this rotational movement, a counter force by the piston 47 against the movement of the piston 27 always acts upon the second indexing plate 40. Accordingly, the first and second indexing plates 20 and 40 are respectively pressed upon the rod 23 and the pawl 43, so that the rotational movement of the work spindle 16 reliably follows the movement of the piston 27. From the foregoing, it will be apparent that the pressure of the fluid to the cylinder 48 is choosen to be lower than that of fluid to the cylinders 26 and 29 and therefore that either of the pistons 27 and 30 is movable against the counter force by the piston 47.

Figure 6:
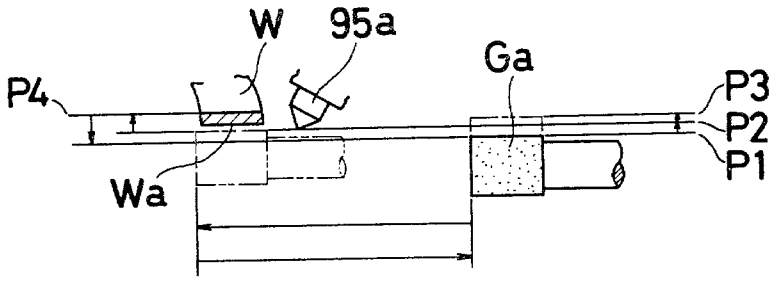
FIG. 6 is an explanatory view descriptive of the movement of a first grinding wheel during dressing operation.

The oscillatory device 14 is then brought into operation to impart reciprocation movement to the work slide 11, and therefore, the cage member W on the chuck 17 is reciprocally moved in a direction transverse to the axis of the work spindle 16 as the spindle is rotated. In this condition, fluid under pressure is supplied to the right chamber of the rapid feed cylinder 70*a* to move the piston 72*a* toward the left as seen in FIG. 3*a*. The feed nut 67*a* is thus rotated through the rack teeth 77*a* and the pinion 76*a*, and this results in rapid advancement of the first wheel support 64*a* and, hence, the first grinding wheel Ga, in a direction parallel to the axis of the work spindle 16. Since the grinding infeed cylinder 71*a* has received fluid under pressure at the left chamber thereof to maintain the piston 73*a* at the right stroke end, the advance movement of the piston 72*a* is discontinued at the position where the rod 74*a* comes into contact with the rod 75*a*. This causes the first grinding wheel Ga to stop at a rapid feed end position P2 as shown indicated in FIG. 6. When subsequent operation of the dressing infeed device 78*a* effects the rotation of the screw shaft 68*a*, the first wheel support 64*a* is moved in a direction parallel to the axis of the work spindle 16 so as to advance the first grinding wheel Ga to a dressing infeed end position P3 as indicated in FIG. 6. The first feed device 63*a* is then operated to move the first wheel slide 60*a* toward the left. The first grinding wheel Ga is brought into engagement with the dressing tool 95*a* in mid course of its leftward movement and is dressed by the dressing tool 95*a* with the result that the grinding surface of the first grinding wheel Ga is reduced to the rapid feed end position P2.

The leftward movement of the first wheel support 64*a* is further continued until the piston 62*a* reaches its right stroke end to extend the first grinding wheel Ga into the cage slot Wp of the cage member W on the chuck 17. Thereafter, fluid under pressure is gradually exhausted from the left chamber of the grinding infeed cylinder 71*a*, which permits the piston 72*a* to further advance together with the piston 73*a*, thereby rotating the feed nut 67*a* again. The first wheel support 64*a* is advanced at a grinding feed rate in a direction parallel to the axis of the work spindle 16. As a result, the first grinding wheel Ga is infed toward the edge Wa on one side of the cage slot Wp and begins to grind the edge. When the piston 73*a* is advanced to the left stroke end thereof, the first grinding wheel Ga reaches its infeed end position P4 as indicated in FIG. 6, whereby the edge Wa in one side of the cage slot Wp is ground to a predetermined size.

Subsequently, fluid under pressure is supplied into the left chambers of the rapid feed cylinder 70*a* and the grinding infeed cylinder 71*a*, whose pistons 72*a* and 73*a* are thus moved toward the right. This effects reverse rotation of the feed nut 67*a*, which in turn effects retraction movement of the first wheel support 64*a* until the first grinding wheel Ga is withdrawn to the retracted end position P1 as shown in FIG. 6. Following the retraction of the first wheel support 64*a*, the reverse operation of the first feed device 63*a* is effected to retract the first wheel slide 60*a* in a direction transverse to the axis of the work spindle 16. The first grinding wheel Ga is thus extracted from the cage slot Wp of the cage member W on the chuck 17, whereby the grinding of the edge Wa on one side of the cage slot Wp is completed.

At the same time as the aforementioned sequential movements of the first grinding wheel Ga, the second grinding wheel Gb is successively given a rapid feed movement, a dressing infeed movement, a traverse extension movement, and a grinding infeed movement. In each of these movements the second grinding wheel Gb is moved in a direction opposite to that in which the first grinding wheel Ga is moved during the aforementioned corresponding movement. Accordingly, the edge Wb on the other side of the cage slot Wp which is diametrically opposed to the cage slot Wp ground in the first grinding wheel Ga is ground with the second grinding wheel Gb when the same is given a grinding infeed movement. The reverse operations of the second grinding infeed device 69*b* and the second feed device 62*b* are then carried out, whereby the second grinding wheel Gb is returned to its original position.

When the first and second grinding wheels Ga and Gb are returned to their original positions, the supply of pressurized fluid to the left and right chambers of the reciprocation drive cylinder 26 is stopped to discontinue the rotational movement of the work spindle 16. Fluid under pressure is then supplied to the right chamber of the indexing cylinder 46, whose piston 47 is thus moved toward the left with a result that the pawl 43 is slid over the circumferential surface of the second indexing plate 40 so as to be retracted in clockwise direction. Immediately after this operation, fluid under pressure is also supplied to the right chamber of the set-free cylinder 29, and this causes the leftward movement of the piston 30 to disengage the rod 23 from one of the stops 21 on the first indexing plate 20. When the pawl 43 is clockwise retracted slightly beyond another notch 41 next to the previously engaged notch 41, fluid under pressure is supplied into the left chamber of the indexing cylinder 46 so that the pawl 43 begins to advance in counterclockwise direction. The pawl 43 is engaged with the new notch 41 in the course of its counterclockwise movement and is further advanced as it positively rotates the second indexing plate 40. Immediately after the counterclockwise movement of the first and second indexing plates 20 and 40, fluid under pressure is supplied into the left chamber of the set-free cylinder 29 to move the rod 23 toward the right. This causes the rod 23 to come into abutting engagement with another or a new stop 21 next to the previous stop 21 with which the rod 23 was earlier in abutting engagement, and further causes the first and second indexing plates 20 and 40 to rotate to the angular position established by the piston 30 at the right stroke end thereof. The work spindle 16 and the cage member W are thus rotated through a predetermined angle (60 degrees in this embodiment) in the counterclockwise direction as viewed in FIG. 4, whereby another pair of diametrically opposite cage slots Wp are brought into alignment with the first and second grinding wheels Ga and Gb.

Figure 7:
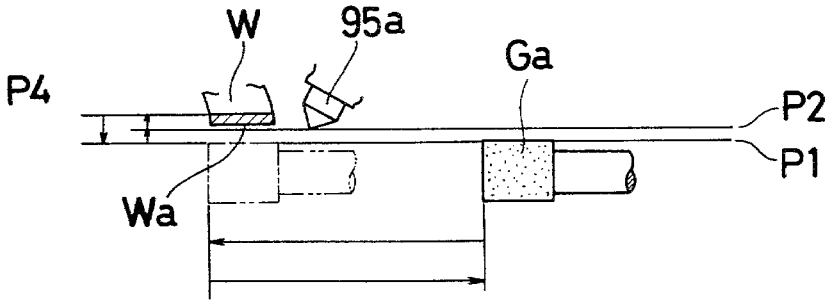
FIG. 7 is another explanatory view descriptive of the movement of the first grinding wheel during grinding operation.

Upon completion of the indexing operation, fluid under pressure is distributed alternatively to the left and right chambers of the reciprocation drive cylinder 25, and rotational movement of the cage member W is restarted for the grinding of another pair of newly indexed cage slots Wp. Since dressing the grinding wheels Ga and Gb is unnecessary for the newly indexed cage slots Wp, the first feed device 63*a* is operated to advance the first wheel slide 60*a* toward the left, and the first grinding wheel Ga is extended into one of the newly indexed cage slots Wp as shown in FIG. 7. Subsequent supply of pressurized fluid to the right chamber of the rapid feed cylinder 70*a* effects the leftward movement of the piston 72*a* accompanying the rotation of the feed nut 67*a*, and by the consequent rapid advance movement of the first wheel support 64*a*, the first grinding wheel Ga is rapidly advanced from the retracted end position P1 to the rapid feed end position P2. The movement of the piston 72*a* is controlled by the piston 73 after abutting engagement of the rod 74*a* with the rod 75*a*. As a result, the first grinding wheel Ga is further advanced at the grinding feed rate which corresponds to the speed of the piston 73*a*, to grind the edge Wa on one side of the cage slot Wp. As the piston 73*a* reaches its left stroke end which establishes the grinding infeed end position P4 of the first grinding wheel Ga, fluid under pressure is supplied into the left chambers of the rapid feed cylinder 70*a* and the grinding infeed cylinder 71*a* to effect the reverse rotation of the feed nut 67*a*. The first wheel support 64*a* is thus retracted until the first grinding wheel Ga reaches the retracted end position P1 as shown in FIG. 7. Further, reverse operation of the first feed device 63*a* is performed to retract the first wheel slide 60*a*, thereby withdrawing the first grinding wheel Ga from the newly indexed cage slot Wa, and this results in the completion of grinding the edge Wa on one side of the newly indexed cage slot Wa.

During the above-described movement of the first grinding wheel Ga, the second grinding wheel Gb is also moved in the same manner as described above but in an opposite direction for each movement. Accordingly, the grinding operation for the edge Wb on the other side of the other newly indexed cage slot Wp is also completed when the second grinding wheel Gb is retracted to the original position almost at the same time as return of the first grinding wheel Ga to the original position therefor.

Furthermore, efficient simultaneous grindings are performed with respect to the edge Wa on one side and the edge Wb on the other side of a succeeding pair of diametrically opposite cage slots Wp. This is accomplished in the same manner as the above-described simultaneous grindings by bringing the succeeding pair of the cage slots Wp into alignment with the first and second grinding wheels Ga and Gb and then by imparting to these wheels Ga and Gb oppositely directed infeed movements along the axis of the work spindle 16 after extensions of the wheels Ga and Gb into the cage slots Wp.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cage slot grinding machine for grinding a plurality of cage slots formed on a circumferential surface of a cage member, comprising:

a bed;

a work head provided on said bed;

a work spindle rotatably carried on said work head and adapted to hold said cage member at one end thereof;

first and second support means slidably mounted on said bed for movement in first and second directions, said directions being respectively perpendicular and parallel to the axis of said work spindle, said first and second support means respectively carrying first and second grinding wheels each rotatable about an axis perpendicular to the axis of said work spindle;

a spindle indexing device connected to said work spindle for angularly indexing said work spindle so as to successively bring said cage slots, two at a time, into alignment respectively with said first and second grinding wheels;

traverse feed means connected with said first and second support means for moving the same in said first direction, but in opposite senses, so as to extend said first and second grinding wheels respectively into said two of said cage slots brought into alignment therewith;

infeed means connected with said first and second support means for moving the same in said second direction but in opposite senses so as to infeed said first and second grinding wheels respectively toward an edge on one side of one of said two cage slots and an edge on the other side of the other of said two cage slots; and rotational oscillatory means connected with said work spindle for rotationally oscillating the same along a predetermined angular distance.

2. A cage slot grinding machine as set forth in claim 1 wherein said work head is slidable on said bed for movement in said first direction, further comprising:

a straight oscillatory device connected with said work head for oscillating the same within a predetermined straight distance in said first direction.

3. A cage slot grinding machine as set forth in claim 1 or 2, wherein said first and second support means comprise:

first and second transverse slides slidably mounted on said bed and connected with said transverse feed means for being moved by the same in said first direction but in opposite senses so as to extend said first and second grinding wheels respectively into said two of said cage slots brought into alignment therewith; and first and second infeed slides slidable respectively on said first and second traverse slides and connected with said infeed means for being moved by the same in said second direction but in opposite senses so as to infeed said first and second grinding wheels respectively toward an edge on one side of one of said two cage slots and an edge on the other side of the other of said two cage slots.

4. A cage slot grinding machine as set forth in claim 3, wherein said infeed means comprises first and second infeed devices provided respectively between said first traverse and infeed slides and between said second traverse and infeed slides and each including:

a screw shaft rotatably supported by one of said traverse and infeed slides associated thereto and extending in said second direction;

a nut rotatably carried by the other of said traverse and infeed slides associated therewith and threadedly engaged with said screw shaft;

a rack-pinion mechanism including a rack member and connected with said nut for rotating the same;

a rapid feed actuator connected with said rack member for moving the same at a fast speed; and a slow feed actuator cooperable with said rack member for moving the same at a slow speed.

5. A cage slot grinding machine as set forth in claim 4, further comprising:

first and second dressing infeed devices connected respectively with said first and second infeed devices for intermittently rotating said screw shaft of an associated one of said first and second infeed devices so as to thereby impart a dressing infeed movement to each of said first and second grinding wheels.

* * * * *